US005701693A

United States Patent [19]

Brocious et al.

[11] Patent Number: 5,701,693

[45] Date of Patent: Dec. 30, 1997

[54] BERM CLEARING ATTACHMENT FOR ROAD CLEARING VEHICLES

[75] Inventors: George Dale Brocious, Mayport; Clifford Wayne Smith; Wayne Carl Snyder, both of Punxsutawney, all of Pa.

[73] Assignee: Edge Development, Inc., Mayport, Pa.

[21] Appl. No.: 589,643

[22] Filed: Jan. 22, 1996

[51] Int. Cl.[6] ..... E02F 5/00

[52] U.S. Cl. ..... 37/381; 37/407; 37/105; 414/723; 172/305

[58] Field of Search ..... 37/381, 383, 384, 37/410, 407, 903, 274, 281, 105; 172/305, 684.5, 810, 811, 779, 780, 781; 414/723, 704, 718, 608

[56] References Cited

U.S. PATENT DOCUMENTS

| | | | |
|---|---|---|---|
| 2,348,796 | 5/1944 | Ferwerda et al. | 172/305 |
| 2,644,251 | 7/1953 | Smith | 37/404 |
| 2,709,859 | 6/1955 | Pilch | 172/305 |
| 2,798,315 | 7/1957 | Gifford | 172/305 |
| 3,008,251 | 11/1961 | Cline et al. | 172/305 |
| 3,044,196 | 7/1962 | Kinney . | |
| 3,257,744 | 6/1966 | Buehler | 37/105 |
| 3,440,744 | 4/1969 | Smith | 37/404 |
| 3,445,944 | 5/1969 | Speno | 37/105 |
| 3,459,373 | 8/1969 | Koers | 37/105 X |
| 3,605,297 | 9/1971 | Kershaw | 37/235 X |
| 3,698,487 | 10/1972 | Ruth et al. | 172/781 X |
| 3,720,010 | 3/1973 | Coates | 37/410 X |
| 4,117,944 | 10/1978 | Beckstrom et al. | 414/723 X |
| 4,196,532 | 4/1980 | Muller | 37/105 |
| 4,466,491 | 8/1984 | Tower | 37/303 X |
| 4,643,358 | 2/1987 | Jackson | 172/459 X |
| 4,808,061 | 2/1989 | Cook et al. | 414/723 X |
| 4,951,573 | 8/1990 | Madison | 37/410 X |
| 5,004,398 | 4/1991 | Wagner et al. | 414/723 |
| 5,435,081 | 7/1995 | Hannes | 37/106 |

FOREIGN PATENT DOCUMENTS

| | | | |
|---|---|---|---|
| 626140 | 12/1962 | Belgium | 37/411 |

*Primary Examiner*—Terry Lee Melius
*Assistant Examiner*—Thomas A. Beach
*Attorney, Agent, or Firm*—George C. Atwell

[57] ABSTRACT

A berm clearing attachment for removable securement to a road clearing vehicle, such as a bulldozer, road grader, hi-lift, dump truck, tractor, or skid-steer loader, for side or lateral dozing accumulated dirt and debris off of roads and road berms and away from guiderails by reciprocating laterally with respect to the longitudinal axis of the road clearing vehicle as the vehicle travels on the road and road berm. The berm clearing attachment includes a support framework removably securable to the front of the road clearing vehicle, and when used with the skid loader, the support framework would be removably securable to the front mounting plate of the loader. The berm clearing attachment includes an elongated cylinder housing mounted to the support framework transverse to the axis of travel of the loader along the road and road berm, an inner boom disposed within the cylinder housing and capable of selective, slidable, reciprocable extension and retraction within the cylinder housing in a direction lateral to the longitudinal axis of the loader, and a blade secured to the distal end of the inner boom. The berm clearing attachment also includes a pivoting cylinder secured to the support framework for selectively raising and lowering the cylinder housing with respect to the surface of the road so that the blade can be raised or lowered to facilitate side dozing of dirt and debris.

2 Claims, 4 Drawing Sheets

BERM CLEARING ATTACHMENT FOR ROAD CLEARING VEHICLES

BACKGROUND OF THE INVENTION

The present invention relates to attachments for road clearing vehicles, and more particularly pertains to a berm clearing attachment for bulldozers, dump trucks, road graders, tractors, front-end loaders, hi-lifts, skid-steer loaders, and other types of vehicles that can be used or converted for use as road clearing vehicles.

Among the wide variety of vehicles used as road clearing vehicles, or adapted for use as road clearing vehicles, is the skid-steer loader. The skid-steer loader is a highly versatile piece of equipment which is used on residential, commercial, and industrial building and construction sites, and for various types of road clearing and road work operations. It is easy to operate and maneuver and can be fitted with a number of attachments, each of which performs a specialized task or operation.

The attachments include the following: hydraulic breakers for quickly and easily breaking up concrete; planers for cutting and removing asphalt or concrete; pallet forks for easily moving bulky or palletized material; industrial grapples for handling a variety of hard-to-manage materials; combination buckets for leveling, digging, loading, and dumping; vertical masts for staking, lifting, and loading material; and front scarifiers for asphalt removal and preparing hard-packed ground for digging or landscaping. All of these attachments are easily secured to, and removed from, a front mounting plate that is pivotally secured to the movable arms that extend alongside the loader from rear to front.

Several of the above attachments are used on loaders during road construction, repair, and maintenance. The loaders can be used for road maintenance projects involving clearing and removing dirt and debris that has accumulated on the road berms and around the posts of the guiderails. If there is too much build-up of dirt and debris under the guiderails, false ditches are created causing water to accumulate and run parallel to the roadway resulting in washouts. These washout areas can cause vehicles to become uncontrollable and then the protective function of the guiderails is negated. In fact, a hazardous condition is created in front of and under the guiderails. This highlights the continual necessity of keeping the road berm and guiderails free from the build-up and accumulation of dirt and debris. This problem is particularly severe in areas where large amounts of anti-skid material are used during snow removal operations.

The typical way that highway departments throughout the country do this is by employing work crews using brooms, shovels, and other hand-held implements to manually clear dirt and debris away from the road berm and guiderails. This is obviously a time-consuming, labor-intensive process. Although the skid-steer loader can be fitted with a variety of attachments, no attachment is available which can replace the manual, labor-intensive work of highway crews in clearing away the dirt and debris and thereby maintaining highway safety.

Thus, there is a need for an attachment for the various kinds of road clearing vehicles, such as skid-steer loaders, road graders, and front-end loaders, which is mounted to the vehicle so that as the vehicle travels along the berm of the road, the lateral reciprocating movement of a plow or blade of the attachment relative to the path of travel of the vehicle in a straight line along the road berm pushes, moves, or dozes dirt and debris from the berm and away from the guiderails simultaneous with the continual forward travel of the vehicle.

Some attempts have been made to develop equipment for the sole purpose of moving the build-up from under guiderails. However, previous attempts have resulted in equipment that is expensive, has only a single function, is not readily adaptable to the various kinds of road clearing vehicles, and is very slow and inefficient at performing the side dozing operation. Moreover, such equipment has been very unreliable for extended usage and has been prone to frequent breakdowns.

SUMMARY OF THE INVENTION

The present invention comprehends a berm clearing attachment for use with road clearing vehicles, such as skid loaders, and which dozes lateral to the direction of travel of the vehicle.

The berm clearing attachment includes a support framework which is removably attachable to the pivotable mounting plate of the skid-steer loader, and the pivotable mounting plate is located at the front of the skid-steer loader. The support framework includes a boom pivot member and a tilt-cylinder frame, both of which project forwardly of the support framework. In addition, an elongated cylinder housing is mounted to the lower front portion of the support framework. The cylinder housing is mounted transverse to the longitudinal axis of the loader. Enclosed within the cylinder housing is an inner boom, and the distal end of the inner boom extends past the cylinder housing when the inner boom is in the fully retracted position. The inner boom is actuated for selective, slidable, reciprocable, linear extension and retraction within the cylinder housing by a piston and cylinder arrangement disposed within the inner boom. The inner boom retracts and extends laterally or at a right angle to both the loader and the longitudinal axis of the loader as the loader travels along the road and road berm.

Secured to the distal end of the inner boom is a blade which actually pushes the dirt and debris and performs the dozing operation. The blade can accommodate a blade attachment which is simply a larger blade mounted to the permanent blade for providing the attachment with a wider dozing area.

In order to provide more flexibility for dozing between closely-spaced guiderail posts and other difficult areas and for dozing berms with an irregular contour, the cylinder housing is pivotally mounted to the boom pivot member adjacent one end of the housing, and an opposite end of the cylinder housing is pivotally mounted to the tilt cylinder frame. The tilt cylinder frame includes a cylinder and piston arrangement, and a rod which is partially disposed within the cylinder has an outer end secured to one end of the cylinder housing. The distal end of the cylinder housing projects past the point of pivotable securement to the boom pivot so that the distal end of the cylinder housing always projects past the boom pivot and the support framework. By hydraulically actuating the tilt cylinder, the piston and rod will move upward and displace the cylinder housing from its normal disposition horizontal to the ground or road. This will raise or lower the blade and cause the curve or sweep of the blade to tilt or angle away from its normal disposition which is generally perpendicular to the ground or road. The extension and retraction of the inner boom for side dozing by the blade can occur when the cylinder housing is in the horizontal disposition and also in the pivoted disposition.

It is an objective of the present invention to provide a berm clearing attachment, or lateral plow attachment, which can be removably mounted to a skid-steer loader as well as to other road clearing vehicles.

It is another objective of the present invention to provide a berm clearing attachment which allows both horizontal and angled side dozing on roads, road berms, and around and between guiderails of all types and designs.

Yet another objective of the present invention is to provide a berm clearing attachment which does not require any modification—or only minimum modification—in the hydraulic system and operator controls of the road clearing vehicle to which it is mounted.

A further objective is to insure quick cycle times for both extension and retraction of the inner boom for the purpose of high productivity of the road clearing vehicle, such cycle times being less than one second per foot for both the extension and retraction strokes of the inner boom.

A still further objective of the present invention is to construct a berm clearing attachment which is durable and dependable, and capable of vigorous use without need for excessive maintenance and repair.

These and other objects and advantages will be readily apparent upon a study of the following detailed description and the accompanying drawings wherein:

DETAILED DESCRIPTION OF THE PREFERRED EMBODIMENT

Illustrated in FIGS. 1–9 is a berm clearing attachment 10 or side dozing attachment which is removably attachable to various kinds of road clearing vehicles, including, but not limited to, road graders, bulldozers, dump trucks, hi-lifts, tractors, and skid-steer loaders. The attachment 10 can be constructed to fit the various sizes of the aforementioned road clearing vehicles. A skid-steer loader will be the type of road clearing vehicle used as the representative example for illustrating the structure and purpose of the attachment 10 of the present invention. The attachment 10 includes elements which reciprocate laterally with respect to the longitudinal axis of the vehicle as the vehicle travels on the road and along or on the road berm. The vehicle can also straddle the road and road berm. In contrast to a bulldozer or dump truck fitted with a plow, both of which doze along or at a slight oblique angle to their axes of travel, the present invention dozes laterally, to the side of or at a right angle to both the longitudinal axis of the vehicle and the line of travel of the vehicle to which the present invention is mounted. The longitudinal axis is defined to be an imaginary line that extends through the vehicle, front to back (or back to front), parallel to the path of travel or direction of movement of the vehicle on the road.

Figure 1:
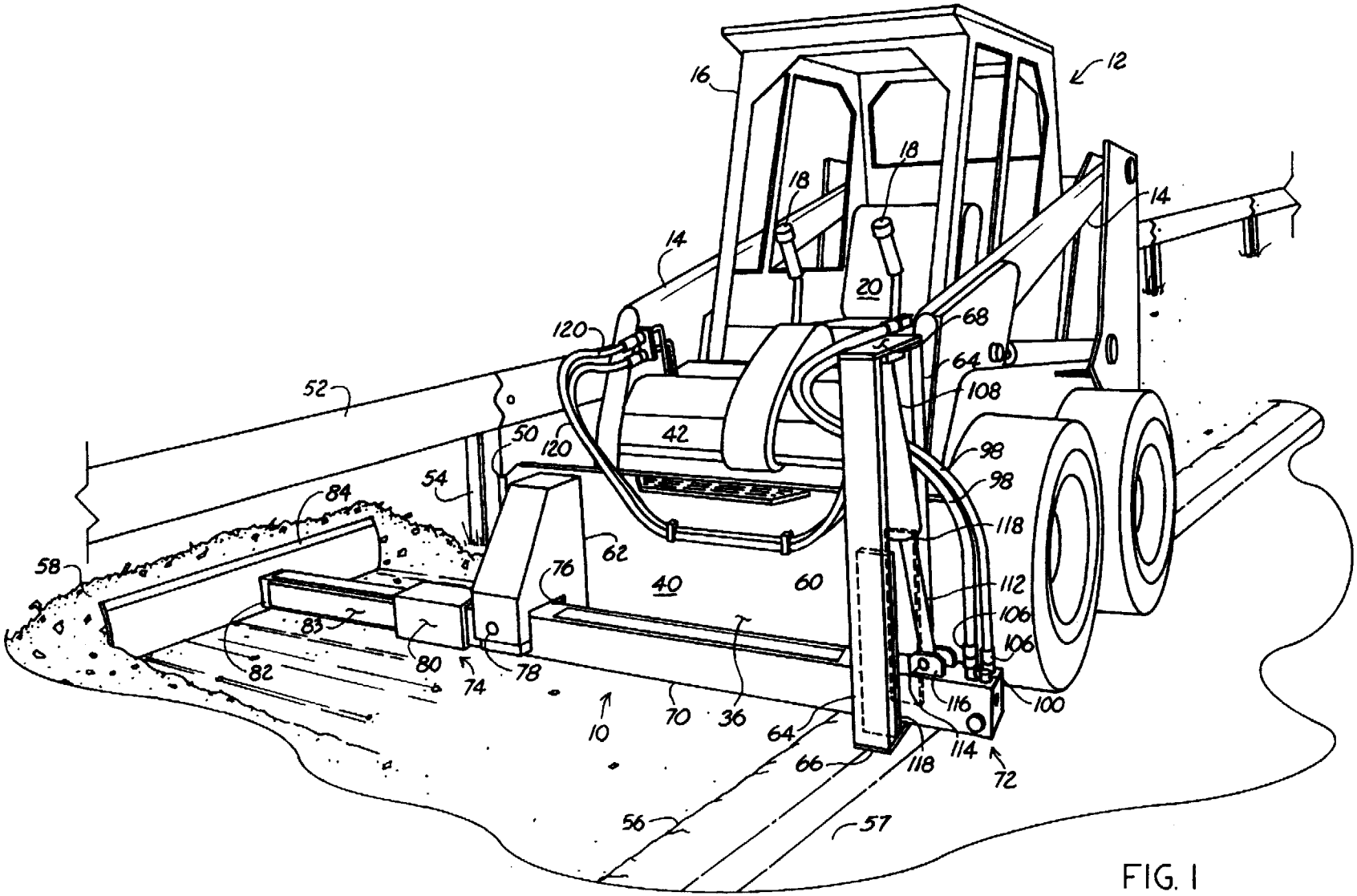
FIG 1 is a perspective view of a berm clearing attachment mounted to a road clearing vehicle, which in FIG. 1 is a skid-steer loader.
Figures 2, 3:
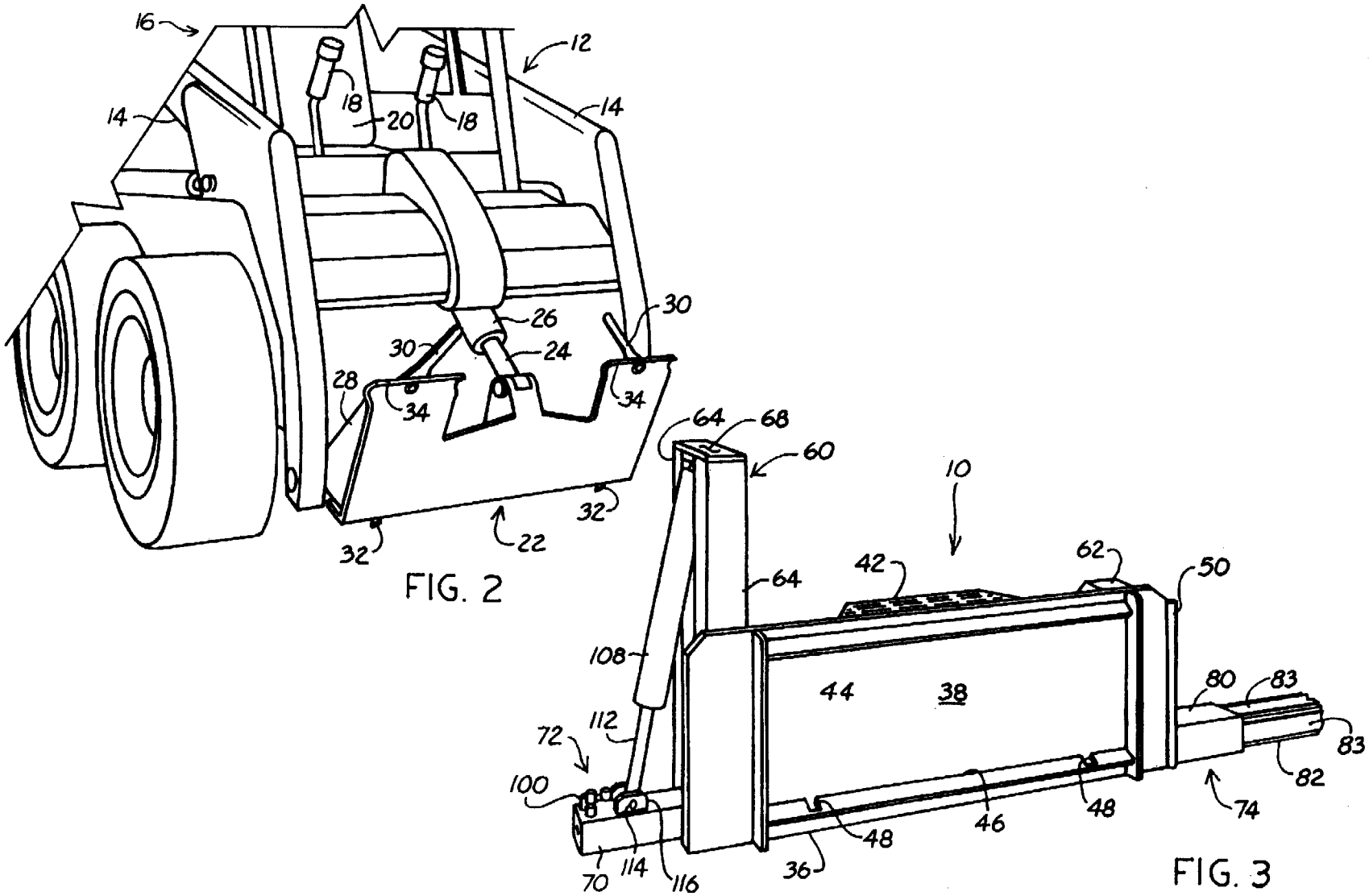
FIG. 2 is a perspective view of the skid-steer loader first shown in FIG. 1 with the berm clearing attachment removed to illustrate the mounting plate of the skid-steer loader.
FIG. 3 is a perspective view of the berm clearing attachment first shown in FIG. 1 illustrating the back of the berm clearing attachment.
Figure 7:
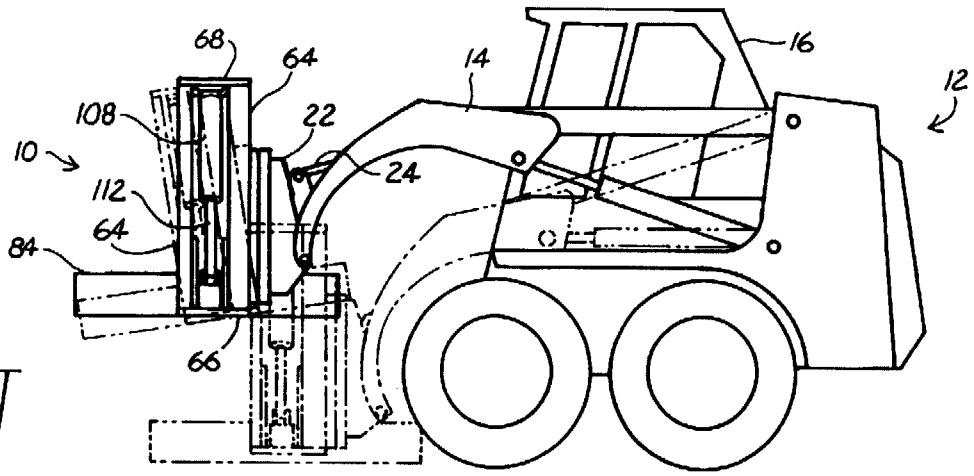
FIG. 7 is a side elevational view of the skid-steer loader and berm clearing attachment first shown in FIG. 1 illustrating the arms of the loader lifting the berm clearing attachment.

All skid-steer loaders have a number of features which allow them to perform a wide range of tasks for different job sites. The skid-steer loader 12 shown in FIGS. 1 and 2 includes a pair of oppositely-disposed, selectively pivotable arms 14 which extend from the back to the front of the loader 12 and between which is located a cab 16 where the operator sits. Manually-operable levers 18 are located within the cab 16 in front of an operator's chair 20 and are used to control the movements of the arms 14 and any attachment, including the attachment 10 of the present invention, mounted to a pivotable mounting plate 22 located directly in front of the loader 12. As shown in FIGS. 1, 2, and 7, the plate 22 is selectively pivoted by a hydraulically-actuated rod 24 and cylinder 26 arrangement and is capable of being lifted up off the ground by the hydraulically-actuated arms 14.

As shown in FIGS. 1, 2, 4, and 7, the plate 22 is essentially a flat plate having three pivot points: the point at which the distal end of the rod 24 is secured to the plate 22, and at the lower ends of the arms 14 where the arms 14 attach to angled support members 28 of the plate 22. The plate 22 includes two manually-operable handles 30 which project from the top edge of the plate 22, and which are pivotably secured thereto. The handles 30 cause pins 32 to retract within the plate 22 or extend downward through slots (not shown) at the bottom of the plate 22 which locks the attachment 10 to the plate or releases the attachment 10 from the plate 22. The plate 22 also includes an upper lip 34 which is designed to receive the lip or flange of any type of attachment so that the flange of the attachment can rest upon the lip 34. In order to secure an attachment to the plate 22, the handles 30 are manually pivoted upward so that the pins 32 retract within the plate 22. Then the attachment is simply lifted off the lip 34 and set aside so that another type of attachment can be set upon the lip 34. Most attachments also include a lower rim or flange which has slots which align with the pins 32 so that after the attachment is set upon the lip 34 and the slots of the attachment are aligned with the slots on the plate 22, the operator manually presses down on the handles 30, causing the pins 32 to extend through the slots on the plate 22 and through the slots located on the lower rim or flange of the attachment, thus locking the attachment to the plate 22. This allows any type of attachment to be quickly and easily mounted to or removed from the plate 22.

Figure 4:
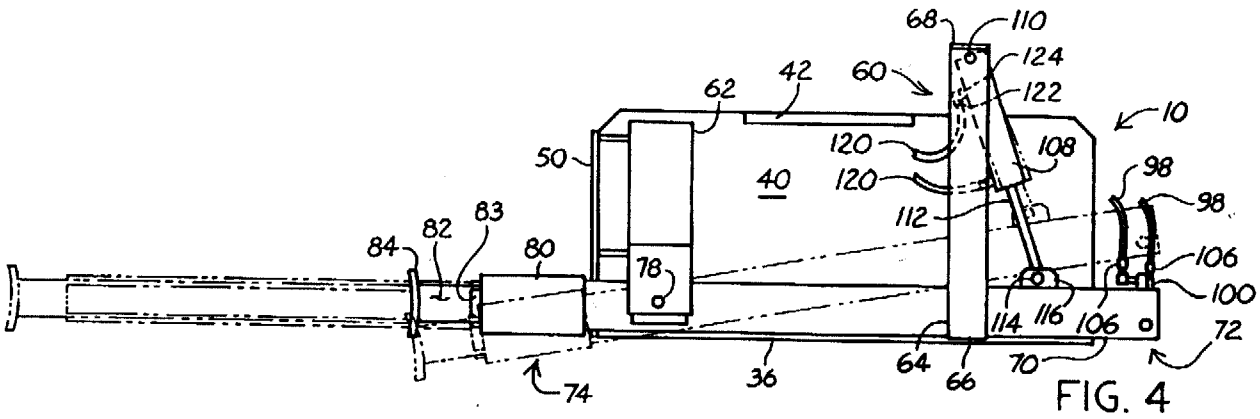
FIG. 4 is a front elevational view of the berm clearing attachment first shown in FIG. 1 illustrating the pivoting of the cylinder housing and the retraction and extension of the inner boom disposed within the cylinder housing.

The attachment 10 shown in FIGS. 1 and 3–9 includes a support framework 36 which is removably attachable to the plate 22. Generally, the framework 36 would be mounted to the front of the road clearing vehicle, such as shown in FIG. 1, for use with the loader 12. However, it is possible that the attachment 10 could be mounted beneath the vehicle and between the front and rear wheels of the vehicle as in the case of use by a road grader or tractor. But, even in this disposition, the attachment 10 would still doze lateral or to the side of the vehicle. The framework 36 includes a rear side 38 which faces the cab 16 and an opposite front side 40. In order to assist the operator in climbing over the framework 36 and getting into the cab 16, a step 42 is provided on the upper edge of the front side 40. The framework 36 also includes an elongated lip or flange 44 secured to the upper edge of the rear side 38, and when the framework 36 is attached to the plate 22, the flange 44 rests upon the lip 34. In addition, attached along the bottom edge of the rear side 38 is an elongated member 46 which is coequal in length with the flange 44. The elongated member 46 includes two pin locking slots 48 which receive the pins 32 when an attachment 10 is placed on the plate 22. As shown in FIGS. 1 and 4, the framework 36 includes a vertically-extending skid bar which (looking out from the cab 16) is integrally secured to the right edge of the framework 36 which is the portion of the framework 36 closest to guiderails 52. The skid bar 50 is designed to receive any impact from guiderails 52, support posts 54, or any other structures located along a road berm 56, or adjacent a road surface 57, and thereby protects the framework 36 from damage.

As illustrated in FIGS. 1 and 3–9, the invention includes a lateral or side dozing means which is used to push dirt 58 and debris off the road berm 56 and away from the guiderails 52. In fact, the term "dozing" is synonymous with "pushing" or "moving" dirt and debris. A tilt cylinder support frame 60 secured to the left side portion of the front side 40 of the framework 36 (with respect to the operator standing in front of the loader 12) and a pivot housing 62 secured to the right-hand side portion of the front side 40 are several of the structural members which comprise the lateral dozing means. The support frame 60 includes a pair of opposed upright struts 64, a bottom flat plate 66 attached to the struts 64, and a top flat plate 68 secured to the upper ends of the struts 64. The lateral dozing means also includes an elongated outer boom, sleeve, or cylinder housing 70 which extends across the lowest portion of the front 40 of the support framework 36 and includes a first end 72 which rests upon the plate 66 attached to the bottom of the frame 60 and a second distal end 74 which is received within and extends through a channel 76 located at the bottom of the housing 62. The housing 70 extends transverse, lateral, or at a right angle to the longitudinal axis of the loader 12 when the loader 12 is traveling on the road 57 or adjacent the berm 56 during a side dozing operation and is spaced a very slight distance above and, in normal dozing operations, parallel to the road berm 56 and road 57. However, the housing 70 does not move laterally with respect to the framework 36 or the movement of the loader 12. Furthermore, the housing 70 is mounted to the housing by means of a pair of pivot pins 78 so that the point where the housing 70 extends through the channel 76 is the pivot point for the housing 70. The portion of the housing 70 that projects past the housing 62 includes a protective housing in the form of hardened steel plates 80 welded to the outside surface of the housing 70. Because this portion of the housing 70 will constantly contact and drag against the ground as the loader 12 proceeds along the road berm 56 during a side dozing operation, the protective housing is necessary to prevent that portion of the housing 70 from being dented or damaged during operation.

Figure 8:
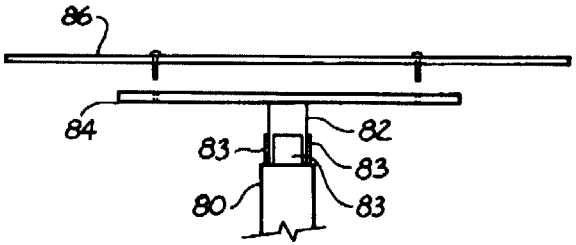
FIG. 8 is a top plan view of a blade attached to the distal end of the inner boom and also illustrating a blade attachment securable to the blade.

As shown in FIGS. 1 and 4–6, disposed within the housing 70 is a sleeve or inner boom 82 which is capable of selective slidable, reciprocable extension and retraction within the housing 70. The movement of the boom 82 is lateral, to the side of, or at a right angle to the longitudinal axis of the vehicle, such as the loader 12 of FIG. 1, whether the loader 12 is stationary or moving on the road 57 and along the berm 56. On each of the four sides of the boom 82 are flat wear strips 83 which provide a wear-resistant surface between the outside surface of the boom 82 and the inside surface of the housing 70. The axis of the boom 82 is concentric with the axis of the housing 70. At no time during extension is the boom 82 fully extended past the housing 70; however, at the point of maximum linear extension, a substantial portion of the boom 82 is exposed and projecting past the portion of the housing 70 surrounded by plates 80. An elongated blade 84 is removably attachable to the distal end of the boom 82 and is the structure which actually pushes or dozes the dirt 58 away from the guiderails 52. The blade 84 moves concomitant with the extension and retraction of the boom 82. In addition, as shown in FIG. 8, a blade extension 86 can be used to extend the width and increase the sweep of the blade 84. The blade extension 86 is simply a longer blade which can be mounted contiguous to the blade 84 by means of bolts which are inserted through aligned holes in both the blade extension 86 and the blade 84.

Although it was stated earlier that the particular size of the attachment 10 can be constructed to fit various sizes and makes of highway and construction equipment, there are specific state and federal regulations which limit the overall length of the housing 70 and blade 84 when the boom 82 is fully retracted. Specifically, the length from the first end 72 of the housing 70 to the blade 84 should not be over eight feet, and, in the present invention, the length is approximately seven feet nine inches when the boom 82 is completely retracted within the housing 70. However, the maximum extension from the end 72 to the blade 82 is approximately twelve feet nine inches. The length from the end 72 to the blade 84 when the blade 84 is retracted to the non-use position, as shown in FIG. 5, is regulated for safety purposes so that any attachment mounted to the loader 12 does not laterally project past the loader 12 to a point where the attachment will interfere with the movement of traffic when the loader 12 travels on a road or highway.

Figure 5:
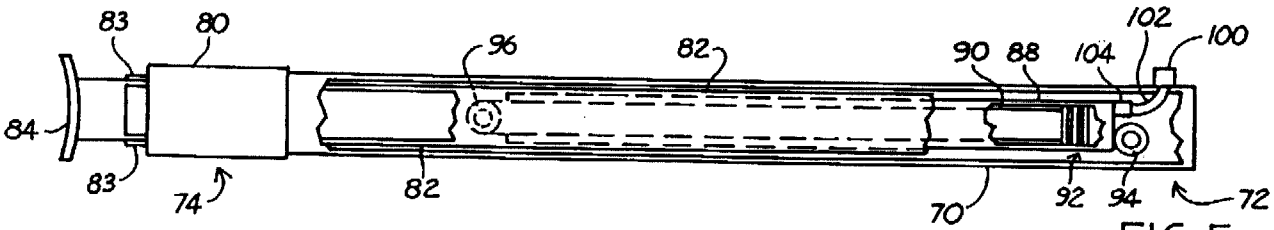
FIG. 5 is a side elevational view of the cylinder housing first shown in FIG. 1 with a portion of the cylinder housing broken away to reveal the inner boom and cylinder within the cylinder housing.
Figure 6:
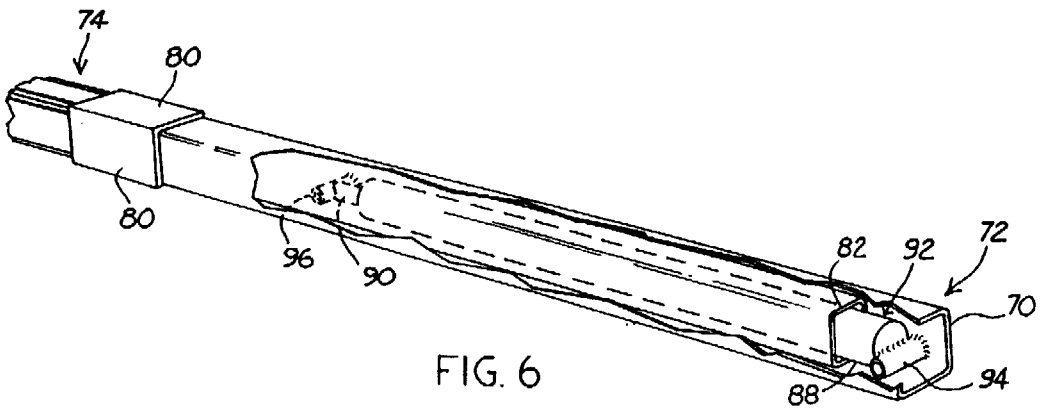
FIG. 6 is a perspective view of the cylinder housing first shown in FIG. 1 with a portion of the cylinder housing broken away to reveal the inner boom and cylinder disposed within the cylinder housing.

As shown in FIGS. 5 and 6, a means for selectively actuating the extension and retraction of the inner boom 82 is completely disposed within the housing 70 and partially within the inner boom 82 and is readily adaptable to the hydraulic system of the loader 12 and other kinds of equipment. Specifically, the actuating means includes a custom-designed push cylinder 88 which is completely disposed within the housing 70. Enclosed within the cylinder 88 is a rod 90 which is capable of selective linear reciprocable movement for extending or retracting the inner boom 82. For the loader 12 illustrated in FIGS. 1 and 2, the cylinder 88 has a two-and-a-half-inch bore, a two-inch diameter rod 90, and a sixty-inch stroke. As shown in FIGS. 5 and 6, a first cylinder end 92 of the cylinder 88 projects past the inner boom 82 for securement to the inside surface of the cylinder housing 70. Specifically, a rear eye or tubular bushing 94 is welded to the outside of the end 92 and the ends of the bushing 94 are welded to opposed inside surfaces at the first end 72 of the housing 70. When the cylinder 88 is in the fully retracted position, as shown in FIG. 6, only a small portion of the rod 90 extends out past the cylinder 88. Moreover, during full retraction, the cylinder 88 is completely enclosed within the boom 82 except for the first end 92. The axis of the cylinder 88 is concentric with the axes of both the housing 70 and boom 82. Mounted to the end of the rod 90 is a boom eye 96 which is also a tubular bushing similar to but slightly shorter in length than the bushing 94. The boom eye 96 is welded to opposed inside surfaces of the inner boom 82 so that when the rod 90 is actuated for extension and retraction, the inner boom 82 will slide within the housing 70 as a result of the attachment of the inner boom 82 to the rod 90 by the boom eye 96. The boom eye 96 and the bushing 94 are all that are necessary to mount the cylinder 88 within the inner boom 82 and cylinder housing 70 and to permit the linear reciprocable movement of the inner boom 82 within the cylinder housing 70.

One of the primary advantages of this invention is that it is adaptable to the hydraulic system of the road clearing vehicle to which it is attached. For example, in the loader 12 illustrated in FIGS. 1 and 2, hydraulic hoses 98 are run from the hydraulic system to hose fittings 100 affixed to the first end 72 of the cylinder housing 70. A pair of short hoses 102, one of which is shown in FIG. 5, extend from the hose fittings 100 located on the outside surface at the first end 72 within the cylinder housing 70 and are in flow communication with hose fittings 104 secured to the first end of the cylinder 88 so that fluid can flow through the hydraulic hoses 98 and 102 to the cylinder 88. As part of the removal of the attachment 10 from the mounting plate 22 of the loader 12 shown in FIGS. 1 and 2, the hose couplings 106, which are part of the hydraulic hoses 98, are simply slipped off the fittings 100 and, thus, the hydraulic hoses 98 can be freed from attachment to the housing 70 and positioned out of the way so that the attachment 10 can be lifted up off of the plate 22.

As shown in FIG. 1, the housing 70 is disposed generally parallel and slightly above the road surface 57. The linear reciprocable extension and retraction of the inner boom 82 causes the blade 84 to push and doze debris 58 away from the guiderails 52 and support posts 54. However, in addition to the level dozing illustrated in FIG. 1, the attachment 10 includes a means for raising or lowering the blade 84 with respect to the berm 56 and road surface 57. In the normal disposition, the housing 70 is slightly spaced above and generally level or horizontal to the road 57. The curve or sweep of the blade is generally perpendicular to the road 57. Specifically, the means for pivoting the cylinder housing 70 so that the blade 84 can be raised or lowered with respect to the berm 56 and road surface 57 includes the tilt cylinder support frame 60 within which a portion of the housing 70 rests when disposed generally parallel to the berm 56 and road surface 57. The housing 70 pivots between the upright struts 64 so that the blade 84 can be raised for dozing at an angle to the road surface 57 and berm 56. The contour of the berm 56 may slope away from the road 57 and, therefore, lowering the blade 82 by pivoting the housing 70 may be necessary for the dozing operation.

The means for pivoting the housing 70 includes a lifting or tilting cylinder 108 which is pivotally mounted at the upper end of the frame 60 by a pair of pivot pins 110. Disposed within the cylinder 108 is a reciprocable rod 112 which moves linearly for extension or retraction to either raise and lift the end 72 toward the upper end of the frame 60 or to return the housing 70 to its generally level disposition with respect to the berm 56 and road surface 57. Raising the end 72 lowers the blade 82, while returning the housing 70 to the normal horizontal disposition with respect to the road 57 raises the blade 82. The distal end of the rod 112 is pivotally mounted to the end 72 of the housing 70 adjacent the hose fittings 100 by pivot pins 114 which rotate on a pair of spaced-apart ears or flanges 116 secured to and which project upwardly from the housing 70. Because of the wear of the outside surface of the housing 70 against the inner surfaces of the struts 64, the lower inside-facing portions of the struts 64 include wear strips 118 to provide a resistive riding surface against which the housing 70 can wear during its upward or downward pivotal movement for tilting or angling the blade 84.

A pair of hydraulic hoses 120 run from the hydraulic system of the loader 12 to the cylinder 108 and hose couplings 122 of the hoses 120 are slipped onto hose fittings 124 which project from the outside surface of the cylinder 108, and which permit the flow of fluid through the hoses 120 and into the cylinder 108 for hydraulic actuation of the rod 112.

Figure 9:
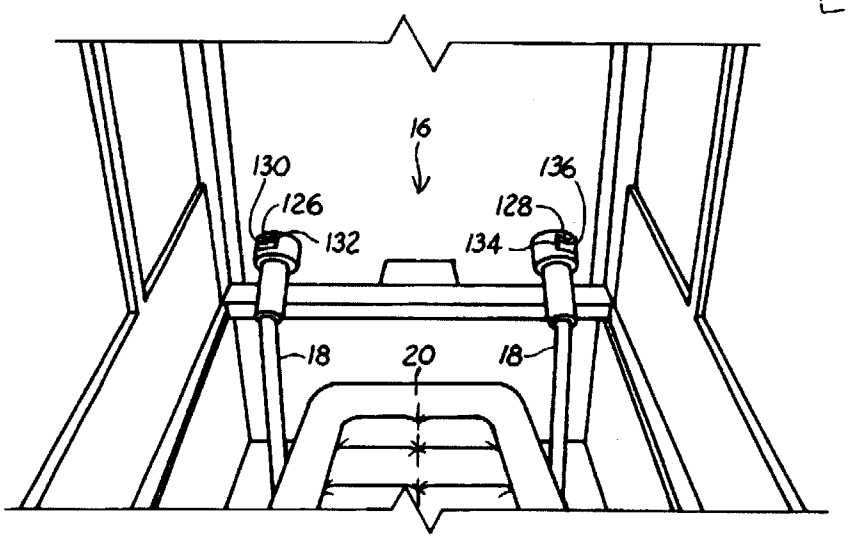
FIG. 9 is a perspective view of the left and right side control levers looking out from the cabin of the skid-steer loader.

As shown in FIGS. 1, 2, and 9, the loader 12 includes two manually-operable control levers 18; specifically, looking out from the cab 16, a left control lever and a right control lever. The left control lever controls the upward or downward, pivotable movement of the housing 70 in order to tilt or angle the blade 84 with respect to the berm 56, while the right control lever controls the stroke, or the extension and retraction, of the inner boom 82 so that the blade 84 can perform a particular dozing operation. Each lever 18 has two rocker switches or dip switches 126 and 128 located at the uppermost ends of the levers 18 and the operator can sit in the cab 16 and control the dozing or pushing of the blade 84 and the tilt of the cylinder housing 70 by simply using his thumbs to press down on the right-hand or left-hand portions of the switches 126 and 128. Hence, pressing a left side portion 130 of the switch 126 on the left control lever 18 actuates the upward pivotal movement of the housing 70 while pressing a right side portion 132 of the switch 126 returns the housing 70 to the level or parallel position with respect to the berm 56 or road surface 57. Pressing a left side portion 134 of the switch 128 for the right control lever 18 actuates the retraction of the inner boom 82 while pressing a right side portion 136 of the switch 128 for the right control lever 18 actuates the extension of the inner boom 82 for dozing by the blade 84.

Thus, the ease of operation of the attachment 10 and also its ready adaptability to various types of road clearing vehicles, such as the loader 12 shown in FIGS. 1 and 2, are significant advantages insofar as when the loader 12 is out in the field or on a job site, the operator can quickly and easily secure the attachment 10 to the mounting plate 22 for side dozing or the operator can easily detach the attachment 10 from the loader 12 so that the loader 12 can perform another function with a different attachment. Furthermore, the extension and retraction of the boom 82 occurs simultaneous with the movement (forward or backward) of the loader 12 along the berm 56. For example, as the loader 12 travels along the berm 56 and road 57, perhaps straddling both, the boom 82 is continuously extending and retracting for side dozing while the loader 12 continues following the berm 56. Thus, the forward or backward movement of the loader 12 occurs simultaneous with the lateral movement of the boom 82 for side dozing with respect to the path or line of travel of the loader 12. No matter what direction the loader 12 moves, the movement of the boom 82 will always be lateral thereto with respect to the longitudinal axis of the loader 12. In addition, the speed of the stroke of the inner boom 82 during both retraction and extension provides for reliable and continuous side dozing. The extension of the inner boom 82 occurs within a time period equal to or less than five seconds or at a rate greater than one foot per second, and the retraction of the inner boom 82 also occurs within a time period equal to or less than five seconds or at a rate greater than one foot per second.

Although the attachment 10 is shown in FIGS. 1, 7, and 9 as dozing to the right-hand side with respect to the operator sitting in the cab 16 and looking out ahead of the loader 12, the structural elements of the attachment 10 can be reversed to permit side dozing on the left-hand side of the loader 12—or on the left-hand side of any other road clearing vehicle.

Finally, the use of a quality, custom-designed push cylinder 88 within the inner boom 82 and the use of durable, high grade steel for the structural elements of the attachment 10 provide a reliable and maintenance-free device for side dozing in all types of weather throughout the year.

While there has been described and illustrated a preferred embodiment for the present invention, it is apparent that numerous omissions, additions, and alterations may be made without departing from the spirit thereof.

We claim:

1. For use in combination with a road clearing vehicle, a berm clearing attachment capable of reciprocably driving a dozing blade generally laterally relative to the direction of travel of the vehicle on a road and road berm, comprising:

a support framework removably attachable to the road clearing vehicle;

an outer boom mounted to the support framework and extending transverse to the longitudinal axis of the road clearing vehicle, the outer boom having a first end and an opposite second end adjacent the road berm which defines the pivot point for the outer boom;

an inner boom disposed within the outer boom for selective slidable extension and retraction within the outer boom lateral to the longitudinal axis of the road clearing vehicle;

the inner boom coextensive with the outer boom so that a substantial portion of the inner boom can project past the outer boom during extension of the inner boom;

a blade removably attachable to the inner boom for side dozing the road berm;

a push cylinder disposed within the outer boom and the inner boom for selectively actuating the extension and retraction of the inner boom, the push cylinder having a first cylinder end secured to the first end of the outer boom and a rod substantially disposed within the cylinder for selective linear reciprocable movement therein to extend and retract the inner boom, the rod having a boom eye secured to the inner boom; and means for pivoting the outer boom secured to the first end of the outer boom so that the blade can be raised or lowered for dozing the road berm.

2. For use in combination with a road clearing vehicle, a berm clearing attachment capable of reciprocably driving a dozing blade generally laterally relative to the direction of travel on a road and road berm, comprising:

a support framework removably attachable to the road clearing vehicle;

an outer boom mounted to the support framework and extending transverse to the longitudinal axis of the road clearing vehicle, the outer boom having a first end and an opposite second end adjacent the road berm which defines the pivot point for the outer boom;

an inner boom disposed within the outer boom for selective slidable extension and retraction within the outer boom lateral to the longitudinal axis of the road clearing vehicle;

a blade removably attachable to the inner boom for side dozing the road berm;

a push cylinder disposed within the outer boom and the inner boom for selectively actuating the extension and retraction of the inner boom so that the inner boom moves lateral to the vehicle and on or above the road and road berm to allow the blade to push dirt and debris off the road and road berm, the push cylinder having a first cylinder end secured to the first end of the outer boom and a rod substantially disposed within the push cylinder for selective linear reciprocable movement therein to extend and retract the inner boom, the rod having a boom eye secured to the inner boom; and means for pivoting the outer boom secured to the first end of the outer boom so that the blade can be selectively raised or lowered for dozing the road berm.

* * * * *